US007990236B2

(12) United States Patent
Chen et al.

(10) Patent No.: US 7,990,236 B2
(45) Date of Patent: Aug. 2, 2011

(54) LOW-PASS FILTER

(75) Inventors: Hsin-Ping Chen, Taipei Hsien (TW); Meng-Hung Hsieh, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 430 days.

(21) Appl. No.: 12/193,775

(22) Filed: Aug. 19, 2008

(65) Prior Publication Data

US 2009/0243759 A1 Oct. 1, 2009

(30) Foreign Application Priority Data

Apr. 1, 2008 (CN) ..... 2008 2 0300486 U

(51) Int. Cl.
*H01P 1/203* (2006.01)

(52) U.S. Cl. ..... 333/204

(58) Field of Classification Search ..... 333/202–205, 333/219, 165–167, 185
See application file for complete search history.

(56) References Cited

U.S. PATENT DOCUMENTS

2006/0082424 A1* 4/2006 Chang ..... 333/204
2007/0216498 A1* 9/2007 Chen ..... 333/204

* cited by examiner

*Primary Examiner* — Benny Lee
*Assistant Examiner* — Gerald Stevens
(74) *Attorney, Agent, or Firm* — Frank R. Niranjan

(57) ABSTRACT

A low-pass filter (10) includes an input portion (100) for input of an electromagnetic signal, an output portion (120) for output of the electromagnetic signal, a high impedance transmission portion (140) electrically connecting the input portion and the output portion, a pair of low impedance transmission portions (160, 180) arranged on either side of the high impedance transmission portion, and a capacitor. One of the low impedance transmission portions electrically connects the input portion and one end portion of the high impedance transmission portion. The other low impedance transmission portion electrically connects the output portion and the other end portion of the high impedance transmission portion. One end of the capacitor is electrically connected to the high impedance transmission portion. The high impedance transmission portion is symmetrical about the capacitor.

11 Claims, 3 Drawing Sheets

LOW-PASS FILTER

BACKGROUND

1. Field of the Invention

The present invention generally relates to filters, and more particularly to a low-pass filter.

2. Description of Related Art

Conventionally, when a wireless network device operates at high power, harmonic components of high frequencies are generated due to the nonlinear properties of the active components of the device, causing electromagnetic interference (EMI).

To address this, a filter is soften used to suppress the harmonic components. Some manufacturers use a waveguide element, such as a microstrip, formed on a printed circuit board of the device.

Features of an ideal filter are signal attenuation of zero within a pass band becoming infinite within a stop band. However, most filters do not achieve or approach these ideals.

Therefore, a need exists in the industry to overcome the described limitations.

SUMMARY

In an exemplary embodiment, a low-pass filter includes an input portion inputting an electromagnetic signal, an output portion outputting the electromagnetic signal, a high impedance transmission portion electrically connecting the input portion and the output portion, a pair of low impedance transmission portions arranged on either side of the high impedance transmission portion, and a capacitor. One of the low impedance transmission portions is electrically connected to the input portion and an end portion of the high impedance transmission portion. The other low impedance transmission portion is electrically connected to the output portion and another end portion of the high impedance transmission portion. One end of the capacitor is electrically connected to the high impedance transmission portion. The high impedance transmission portion is symmetrical about the capacitor.

Other objectives, advantages and novel features of the present invention will be drawn from the following detailed description of preferred embodiments of the present invention with the attached drawings, in which:

DETAILED DESCRIPTION OF THE EMBODIMENTS

Figure 1:
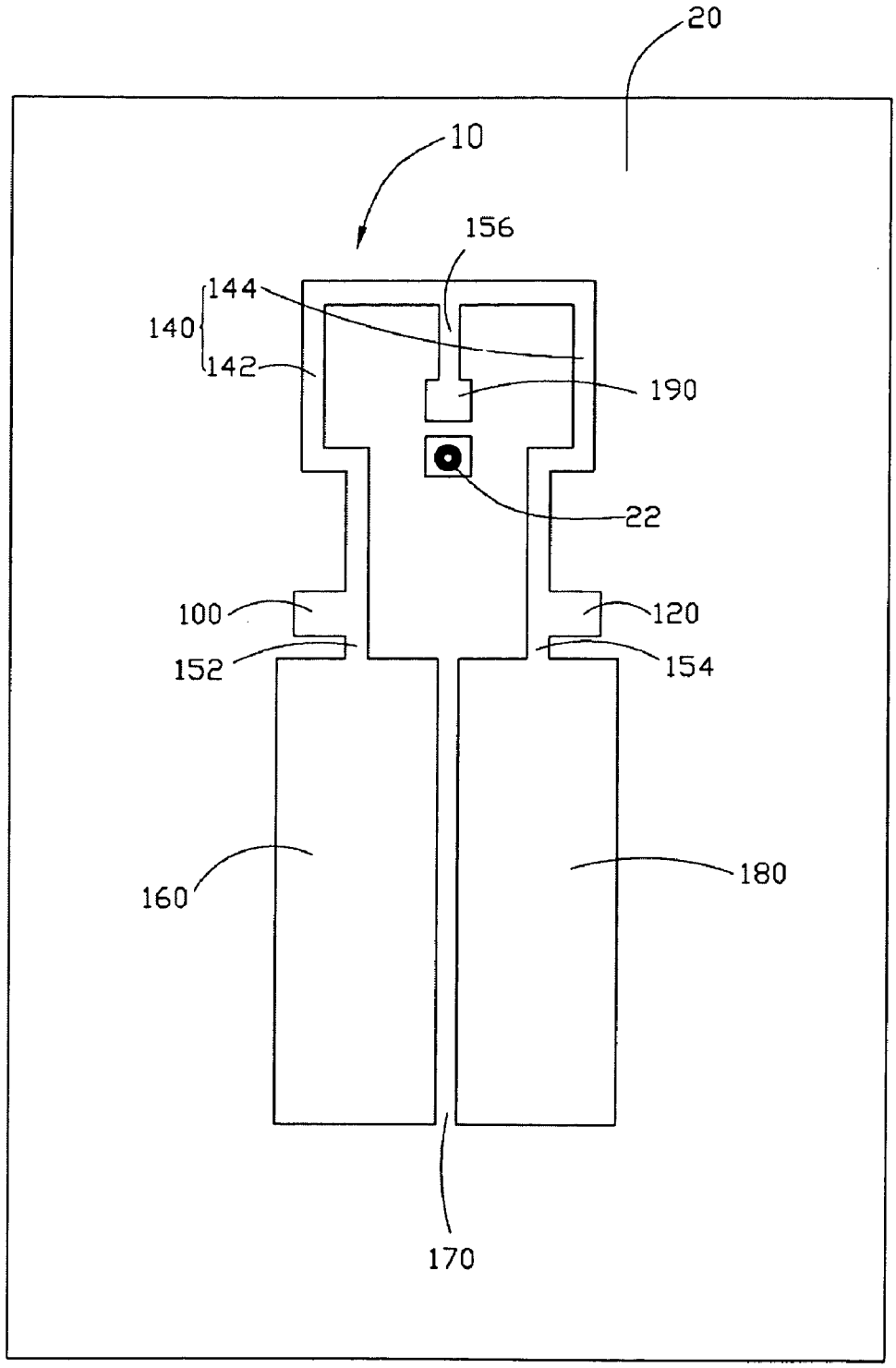
FIG. 1 is a schematic diagram of a low-pass filter of an exemplary embodiment of the invention.

FIG. 1 is a schematic diagram of a low-pass filter 10 of an exemplary embodiment of the present invention. The low-pass filter 10 is printed on a printed circuit board (PCB) 20, and is a microstrip filter.

The low-pass filter 10 includes an input portion 100, an output portion 120 aligned with the input portion 100, a high impedance transmission portion 140, a first connecting portion 152, a second connecting portion 154, a third connecting portion 156, a first rectangular low impedance transmission portion 160, a second rectangular low impedance transmission portion 180 parallel to the first low impedance transmission portion 160, and a pair of metal plates 190 parallel to and aligned with each other. In other embodiments, a capacitor can be used rather than the metal plates 190.

The input portion 100 inputs electromagnetic signals. The output portion 120 outputs the electromagnetic signals. The input portion 100 and the output portion 120 each have impedance values of approximately 50 ohms (Ω).

The high impedance transmission portion 140 extends symmetrically about the third connecting portion 156, and electrically connects the input portion 100 to the output portion 120, transmitting the electromagnetic signals therebetween. The high impedance transmission portion 140 comprises a first high impedance transmission portion 142 and a second high impedance transmission portion 144, symmetrical about the third connecting portion 156. An end portion of the high impedance transmission portion 140 is electrically connected to the input portion 100 and the first connecting portion 152. Another end portion of the high impedance transmission portion 140 is electrically connected to the input portion 100 and the second connecting portion 154. A middle portion of the high impedance transmission portion 140 is electrically connected to the third connecting portion 154.

A slot 170 is formed between the first low impedance transmission portion 160 and the second low impedance transmission line 180, opposite to the metal plates 190. One end portion of the first low impedance transmission portion 160 is electrically connected to the first connecting portion 152, and the other is free, such that the first low impedance transmission portion 160 is electrically connected to the end portion of the high impedance transmission portion 140 and the input portion 100 via the first connecting portion 152. Similarly, one end portion of the second low impedance transmission portion 180 is electrically connected to the second connecting portion 154, and the other is free, such that the second low impedance transmission portion 180 is electrically connected to the other end portion of the high impedance transmission portion 140 and the output portion 120 via the second connecting portion 154.

One of the metal plates 190 is located at a distal end of the third connecting portion 156, and is electrically connected to a middle portion of the high impedance transmission portion 140. The other metal plate 190 is electrically connected to ground of the PCB 20 through a via 22. A capacitor C is formed between the two metal plates 190.

In this embodiment, the high impedance transmission portion 140, the first low impedance transmission portion 160 and the second low impedance transmission portion 180 generally surround a closed region. The metal plates 190, and thus the capacitor C, are positioned in the closed region. The input portion 100 and the output portion 120 are arranged symmetrically about the capacitor C, and the high impedance transmission portion 140 is arranged to extend symmetrically about the capacitor C.

In this embodiment, a perimeter of the high impedance transmission portion 140 is 9.83 mm. A line width of the high impedance transmission portion 140 is 0.23 mm. Length and width of the first low impedance transmission portion 160 are respectively 4.55 mm and 1.65 mm. Length and width of the second low impedance transmission line 180 are equal to those of the first low impedance transmission portion 160, respectively. Overall length of the low-pass filter 10 is 8.36 mm, and of the low-pass filter 10, 3.53 mm.

Figure 2:
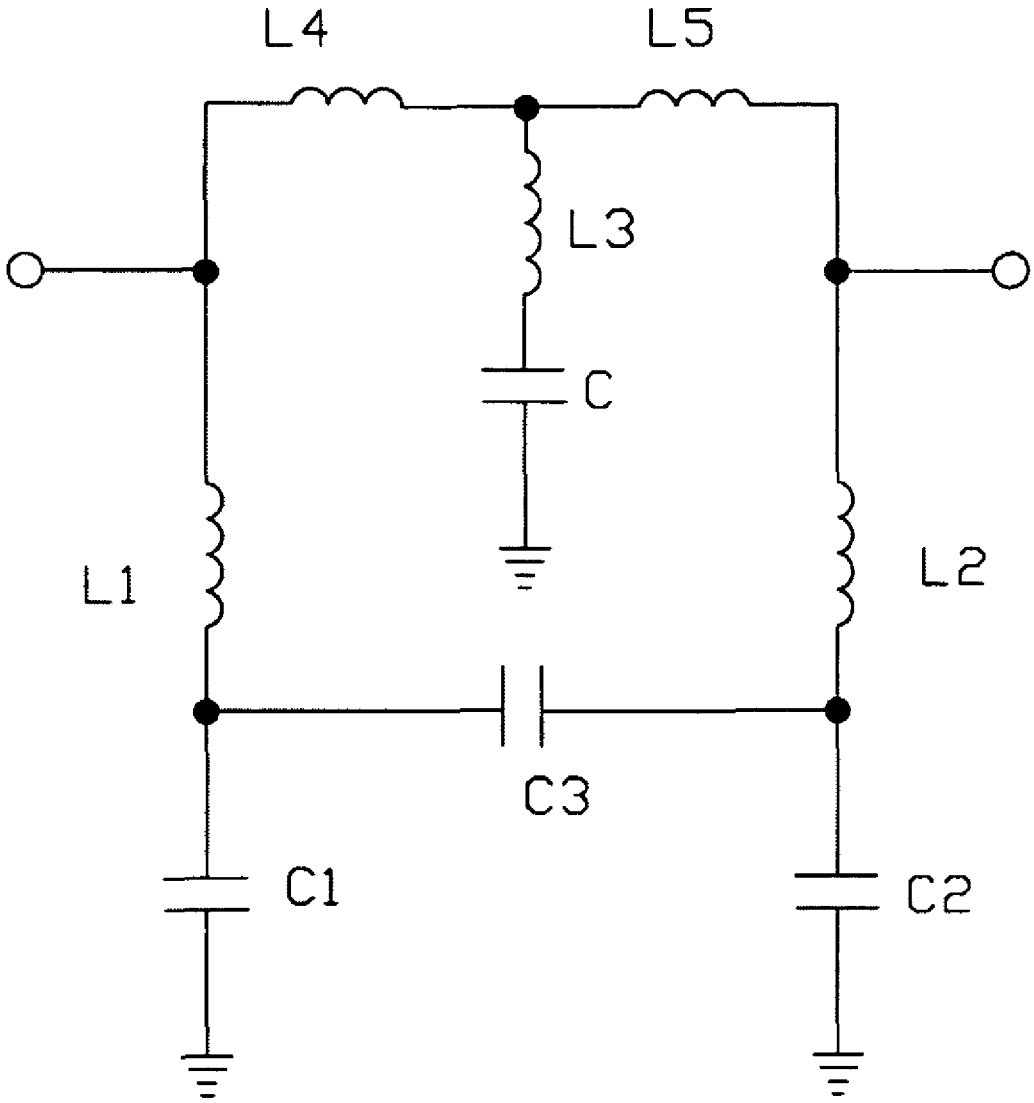
FIG. 2 is a schematic diagram of an equivalent circuit of the low-pass filter of FIG. 1.

FIG. 2 is a schematic diagram of an equivalent circuit of the low-pass filter 10. As shown, the first connecting portion 152, the second connecting portion 154, and the third connecting portion 156 are respectively equivalent to an inductor L1, an inductor L2, and an inductor L3. The first high impedance transmission portion 142 and the second high impedance transmission portion 144 are respectively equivalent to an inductor L4, and an inductor L5. A capacitor C1 is formed between the first low-impedance transmission portion 160 and the ground of the PCB 20. A capacitor C2 is formed between the second low-impedance transmission portion 180 and the ground of the PCB 20. A coupled capacitor C3 is formed between the second low-impedance transmission portion 180 and the first low-impedance transmission portion 160. A coupled capacitor C is formed between the two metal plates 190.

Figure 3:
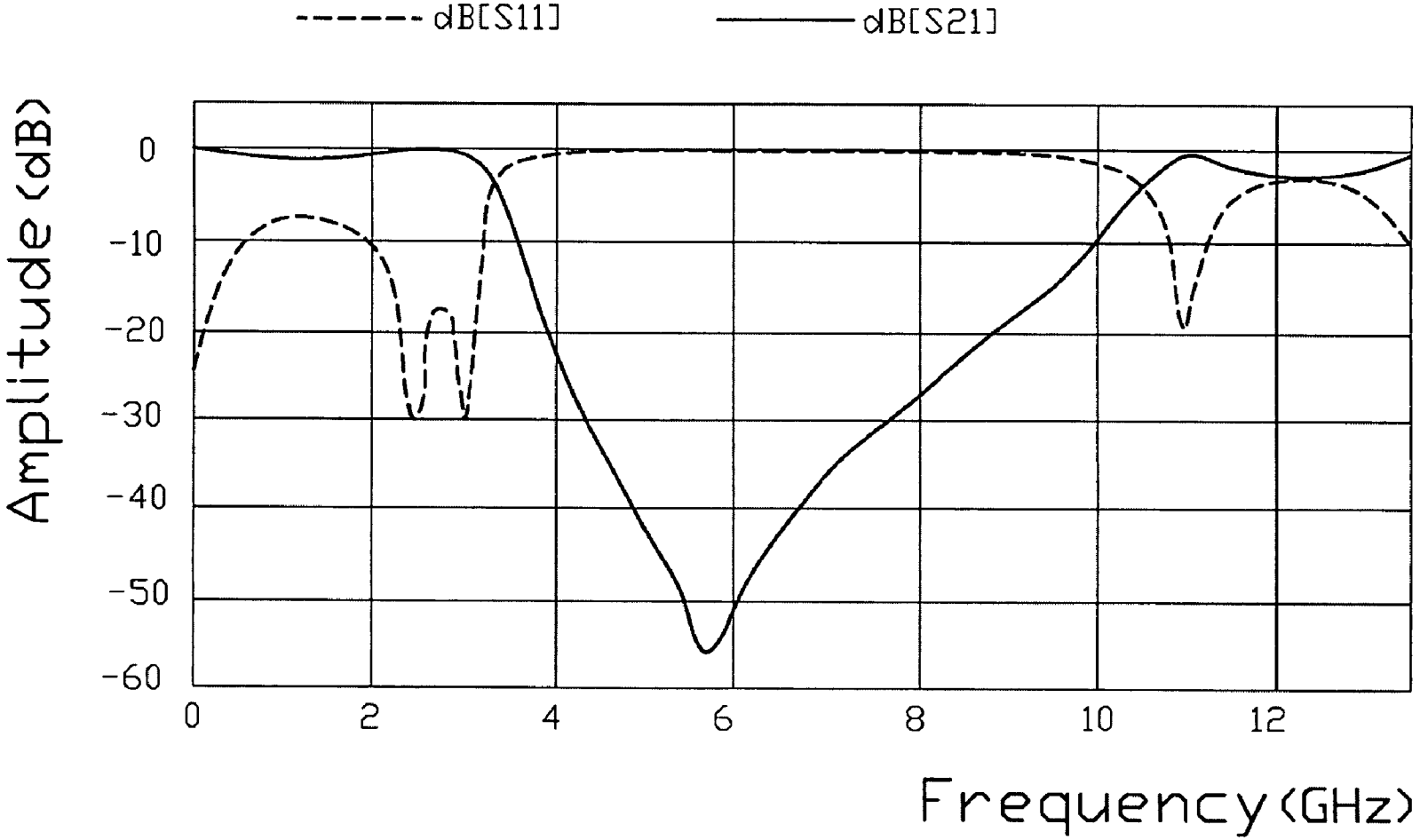
FIG. 3 is a diagram showing a relationship between amplitudes of insertion or return loss and frequency of electromagnetic signals through the low-pass filter of FIG. 1.

FIG. 3 is a diagram showing a relationship between amplitudes of insertion or return loss and frequency of an electromagnetic signal traveling through the low-pass filter 10. The horizontal axis represents the frequency in gigahertz (GHz) of the electromagnetic signal traveling through the low-pass filter 10, and the vertical axis represents amplitudes of the insertion or return loss in decibels (dB) of the low-pass filter 10.

In FIG. 3, the insertion loss is represented by a solid line S21, and the return loss is represented by a broken line S11. The curve S21 indicates a relationship between a value of an input power and a value of an output power of the electromagnetic signals traveling through the filter 10, represented by the formula:

$$S21=-10*\text{Log}\ [(\text{Input Power})/(\text{Output Power})].$$

When the electromagnetic signals pass the filter 10, a part of the input power is returned to a source of the electromagnetic signals, defined as a return power. Curve S11 indicates a relationship between the input power and the return power of the electromagnetic signals traveling through the filter 10, and is represented by the formula:

$$S11=-10*\text{Log}\ [(\text{Input Power})/(\text{Return Power})].$$

For a filter, when the output power of the electromagnetic signal in a pass band frequency range approaches the input power of the electromagnetic signal, distortion of the electromagnetic signal is low and the performance of the low-pass filter increased, there being an inverse relationship therebetween. As shown by curve S21 of FIG. 3, the absolute value of the insertion loss of the electromagnetic signal in the pass band frequency range is close to 0, indicating that low-pass filter 10 performs well.

Because the capacitor C is formed in the closed region of the low-pass filter 10, curve S21 in the pass band frequency range is a smooth, generally horizontal, line. Attenuation rate of the low-pass filter 10 is improved, as is filtering function thereof.

While embodiments of the present invention have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A low-pass filter comprising an input portion, an output portion, a third connecting portion, a high impedance transmission portion, a first low impedance transmission portion, a second low impedance transmission portion and a pair of parallel aligned metal plates, the high impedance transmission portion electrically connecting the input portion and the output portion, the high impedance transmission portion comprising a first high impedance transmission portion and a second high impedance transmission portion the first and second high impedance transmission portions being symmetrical about the third connecting portion, the first low impedance transmission portion electrically connecting the input portion and one end portion of the high impedance transmission portion, the second low impedance transmission portion electrically connecting the output portion and another end portion of the high impedance transmission portion, one of the pair of parallel aligned metal plates electrically connecting to the third connecting portion, and the other metal plate electrically connecting to ground of a PCB through a via.

2. The low-pass filter as recited in claim 1, wherein the input portion and the output portion are arranged symmetrically about the pair of metal plates.

3. The low-pass filter as recited in claim 2, wherein the input portion aligns with the output portion.

4. The low-pass filter as recited in claim 1, wherein a slot is formed between the first and second low impedance transmission portions.

5. The low-pass filter as recited in claim 4, wherein the slot is opposite to the pair of metal plates.

6. A low-pass filter comprising:

an input portion enabling input of an electromagnetic signal;

an output portion enabling output of the electromagnetic signal;

a high impedance transmission portion electrically connecting the input portion and the output portion and transmitting the electromagnetic signal therebetween;

a first low impedance transmission portion electrically connecting the input portion and one end portion of the high impedance transmission portion;

a second low impedance transmission portion electrically connecting the output portion and the other end portion of the high impedance transmission portion; and a pair of parallel aligned metal plates, one of which electrically connects to the high impedance transmission portion, and the other metal plate electrically connecting to ground of a PCB through a via;

wherein the first and second low impedance transmission portions and the high impedance transmission portion generally surround a closed region in which the pair of metal plates are located;

wherein the high impedance transmission portion is symmetrical about the pair of metal plates.

7. The low-pass filter as recited in claim 6, wherein the input portion and the output portion are arranged symmetrically about the pair of metal plates.

8. The low-pass filter as recited in claim 7, wherein the input portion aligns with the output portion.

9. The low-pass filter as recited in claim 6, wherein a slot is formed between the first and second low impedance transmission portions.

10. The low-pass filter as recited in claim 9, wherein the slot is opposite to the pair of metal plates.

11. The low-pass filter as recited in claim 6, wherein a capacitor is formed between the pair of metal plates.

* * * * *